United States Patent [19]

Beigay et al.

[11] 4,381,660

[45] May 3, 1983

[54] METHOD FOR PREVENTING WELD FRACTURE

[75] Inventors: Jack M. Beigay, Freeport; Remus A. Lula, Natrona Heights, both of Pa.

[73] Assignee: Allegheny Ludlum Steel Corporation, Pittsburgh, Pa.

[21] Appl. No.: 232,756

[22] Filed: Feb. 9, 1981

[51] Int. Cl.[3] ..... B21D 11/00

[52] U.S. Cl. ..... 72/342; 148/12 E; 228/155

[58] Field of Search ..... 228/155, 200; 148/12 E, 148/125; 219/128; 72/342, 364

[56] References Cited

U.S. PATENT DOCUMENTS

| | | | |
|---|---|---|---|
| 2,862,294 | 12/1958 | Philip | 228/200 |
| 3,117,369 | 1/1964 | Albert | 228/155 |
| 3,282,748 | 11/1966 | Martens | 228/155 |
| 3,836,748 | 9/1974 | Terai et al. | 148/125 |

*Primary Examiner*—Lowell A. Larson

*Attorney, Agent, or Firm*—Patrick J. Viccaro

[57] ABSTRACT

A method for preventing weld cracking of autogenous weldments of metastable stainless steel during deforming of the weld, as by stretching; this is achieved by cooling the weld with a pressurized $CO_2$ spray during the deforming operation.

6 Claims, No Drawings

METHOD FOR PREVENTING WELD FRACTURE

Metastable austenitic stainless steels, such as AISI Types 201 and 301, are used as weldments for various applications, such as articles for use in automobile trim applications. Metastable alloys of this type are austenitic at room temperature. When welded, the high temperatures to which the weld area is subjected causes the formation of some delta ferrite so that the weld is characterized by the presence of delta ferrite and austenite. When cold worked or deformed the austenitic structure of these alloys undergoes some transformation to martensite.

In the fabrication of parts from these metastable steels it is often necessary to weld and then deform, and in particular stretch, the welded article to various shapes. The presence of a small volume of delta ferrite plus an inherent stress-concentration effect leaves the weld metal as the area of the welded article most susceptible to cracking during deformation. The welded article is comprised of base metal, weld heat-affected zone, and solidified weld metal.

It is accordingly the primary object of the present invention to provide a method of preventing cracking at the weld of autogenous weldments of metastable stainless steels which are subject to deformation of the weldment during fabrication into various shapes.

The austenite in the weld will form a greater amount of martensite than does the base metal during deformation by the expedient of cooling only the weld area. Thus, the weld, when deformed cold, forms more martensite than does the base metal and so premature failure is avoided. Without cooling, much of the deformation is localized in the weaker weld so that the welded article fails at an early stage of deformation. Obviously, if the entire article is cooled all three of the aforementioned zones of the welded article would be restored to the same undesirable strength (work hardening) perspective.

In the practice of the invention, weld cracking in these applications is prevented by spraying the weld area with a pressurized $CO_2$ spray or equivalent to cool the weld area during deforming. The temperature to which the weld area is cooled by this spraying operation will be satisfactory for most applications at 32° F. but cooling to as low as −50° F. may be required for some applications. The temperature to which the weld is cooled is related to the amount of deformation taking place and may be established for a particular application by routine experiment. Specific metastable alloys, to which the invention has been found to have particular advantage, are AISI Types 201 and 301.

As a specific example to demonstrate the invention, standard size tensile specimens with autogenous welds located across the center of the reduced area thereof of AISI Type 301 stainless steel were used for testing. The test results are set forth in the following table:

| Type | Gage | Weld Temp. | Area of Fracture |
|---|---|---|---|
| 301 | 0.030" | Room Temp. | In Weld |
| 301 | 0.030" | Cold | In Base Metal |
| 301 | 0.030" | Room Temp. | In Weld |
| 301 | 0.030" | Cold | In Base Metal |
| 301 | 0.024" | Room Temp. | In Weld |
| 301 | 0.024" | Cold | In Base Metal |
| 301 | 0.024" | Room Temp. | In Base Metal |
| 301 | 0.024" | Room Temp. | In Base Metal |

As may be seen from the data reported in the table, during tensile testing the area of fracture with the tensile specimens that were sprayed with $CO_2$ during stretching and designated in the table as having a weld temmperature of "Cold", did not exhibit weld fractures but instead fractured during testing in the base metal in each instance.

We claim:

1. A method for preventing cracking at the weld area during deformation of an autogenous weldment of metastable stainless steel, said method comprising cooling only said weld area with a pressurized $CO_2$ spray and deforming said weld area during said cooling to form more martensite in the weld than in the base metal.

2. The method of claim 1 wherein said weld area is cooled to a temperature of at least about 32° F. during spraying.

3. The method of claim 1 wherein said metastable stainless steel is a steel selected from the group consisting of AISI Type 201 and AISI Type 301.

4. The method of claim 1 wherein deforming of said weld is by stretching.

5. A method for preventing cracking at the weld area during stretching of an autogenous weldment of metastable AISI Type 201 or 301 stainless steel, said method comprising cooling only said weld area with a pressurized $CO_2$ spray to a temperature of about at least 32° F. and stretching said weld while at said temperature to form more martensite in said weld than in the base metal.

6. A method for preventing cracking at the weld area during deformation of an autogenous weldment of metastable stainless steel, said method comprising cooling only said weld area to a temperature of at least about 32° F. and deforming said weld area during said cooling to form more martensite in said weld than in the base metal.

* * * * *